United States Patent [19]

Dixon et al.

[11] Patent Number: 5,047,908

[45] Date of Patent: Sep. 10, 1991

[54] LIGHTING FITTINGS

[75] Inventors: Angus B. Dixon, Oldham; Wilfred A. Price, Stanmore, both of Great Britain

[73] Assignee: Osram Limited, England

[21] Appl. No.: 619,030

[22] Filed: Nov. 28, 1990

Related U.S. Application Data

[63] Continuation of Ser. No. 527,274, May 23, 1990.

[30] Foreign Application Priority Data

Jun. 6, 1989 [GB] United Kingdom ..... 8912941

[51] Int. Cl.[5] ..... F21V 7/00

[52] U.S. Cl. ..... 362/346

[58] Field of Search ..... 362/304, 305, 346

[56] References Cited

U.S. PATENT DOCUMENTS 910,877 1/1909 Smith ..... 362/346

1,662,322 3/1928 Melton ..... 362/305

2,586,583 2/1952 Wagner ..... 362/346

FOREIGN PATENT DOCUMENTS 400680 11/1933 United Kingdom .

600442 4/1948 United Kingdom .

2224344 2/1990 United Kingdom ..... 362/346

*Primary Examiner*—Carroll B. Dority

*Attorney, Agent, or Firm*—Kirschstein, Ottinger, Israel & Schiffmiller

[57] ABSTRACT

A lighting fitting designed to operate either in the spotlight or flood mode has a reflector (7) extending forwardly of the lamp (1) and comprising a plurality of segments (8A, 8B) pivotable about respective axes (12) which are tangential to a circle centred on the longitudinal axis (X) of the reflector (7). Each segment comprises two longitudinally separate sections (8A, 8B) associated with arms (16) for pivoting them simultaneously but through different angles.

3 Claims, 2 Drawing Sheets

LIGHTING FITTINGS

This is a continuation, of application Ser. No. 07/527,274 filed May 23, 1990 and now abandoned.

BACKGROUND OF THE INVENTION

1. Field of the Invention

This invention relates to lighting fittings of the kind designed for use with electric lamps providing a relatively compact high intensity light source, as may be employed, for example, in studios, theatres, outside locations and other situations where a high degree of directional lighting is required.

2. Description of Related Art

The spread of the light beam produced by such a fitting is often required to be varied so as to enable the fitting to operate in either the spot-light or flood mode, and for this purpose the lamp is commonly supported on a movable carriage with a concave reflector mounted behind it, the carriage assembly being movable towards or away from a Frésnel lens.

A major disadvantage of such an arrangement is that the flux pick up from the lamp is small, particularly for the spot position, when the lamp is furthest from the lens.

A further disadvantage is that an appreciable proportion of the radiations incident upon the reflector are reflected back towards the lamp, resulting in a loss of light, due to absorption, and an increased heating of the lamp, with a consequent shortening of the lamp life due to seal failure.

Although it is possible to utilise a wrap-around reflector, i.e. one that extends forwardly beyond the lamp, to pick up and control a greater proportion of the lamp flux than is possible with a simple concave reflector mounted behind the lamp, a satisfactory change in beam spread between desired spot and flood modes cannot be achieved in such a case simply by moving the lamp along the reflector axis.

SUMMARY OF THE INVENTION

According to the present invention in a lighting fitting of the kind referred to having a reflector extending forwardly of the lamp, the reflector comprises a plurality of separate segments disposed around the lamp and pivotable about respective axes which are tangential to a circle centred on the longitudinal axis of the reflector.

Each reflector segment may be of approximately part-paraboloidal form, so that together they constitute a generally parabolic reflector.

Preferably adjacent reflector segments partially overlap so that they slide over one another as their positions are adjusted.

It has been found that the spread of the beam produced by the lamp, in use of the fitting, can be varied by pivoting the reflector segments in a similar manner to each other through only a relatively small angle, without the need for moving the lamp, or the need to employ a Frésnel lens.

Preferably, however, each segment comprises at least two separate sections disposed end to end or partially overlapping in the direction of the reflector axis, the separate sections being associated with means for pivoting them simultaneously but through different angles.

By utilising appropriately shaped segment sections a change from a flood mode to what is a close approximation to a spot mode can readily be achieved with such an arrangement.

An added advantage is that, compared with an arrangement utilising a concave reflector disposed behind the lamp in association with a Frésnel lens, the amount of light which is re-directed towards the lamp is significantly reduced.

The invention may accordingly be used both to increase the lamp life, and to provide greater output from a given lamp.

The invention is particularly applicable to very high power lamps having a power output of several kilowatts, where overheating and resultant early lamp failure has caused serious problems in existing forms of lighting fitting.

BRIEF DESCRIPTION OF THE DRAWINGS

One lighting fitting in accordance with the invention will now be described by way of example with reference to FIGS. 1 to 3 of the accompanying schematic drawings, in which.

DETAILED DESCRIPTION OF THE PREFERRED EMBODIMENTS

Figure 1:
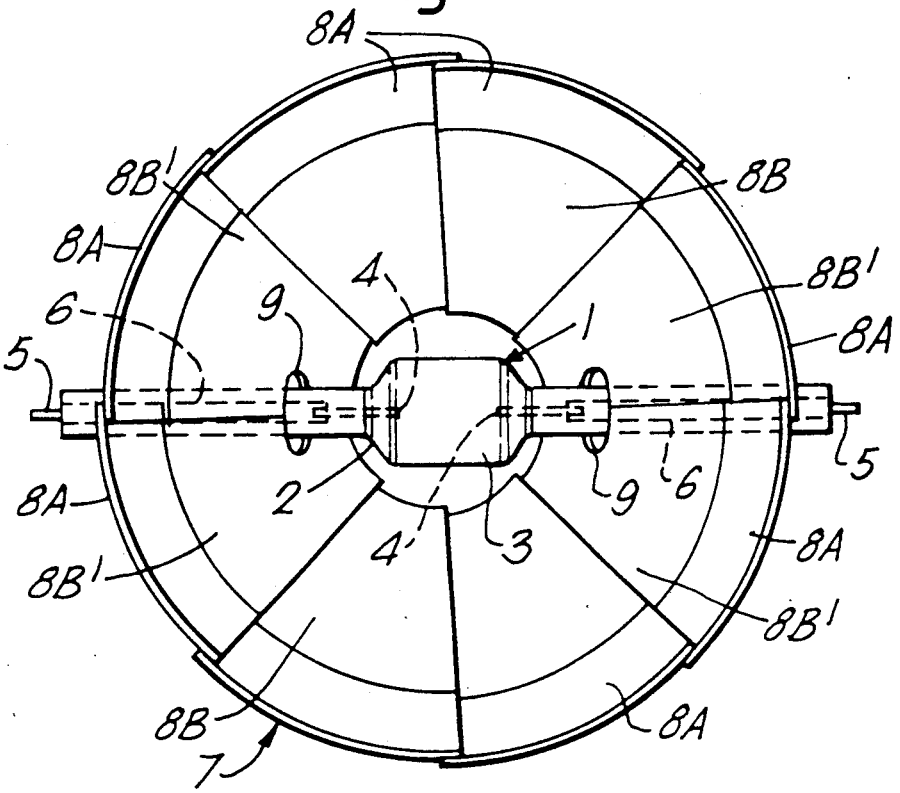
FIGS. 1 and 2 represent a front view and a side view respectively of the relevant part of the fitting.
Figure 2:
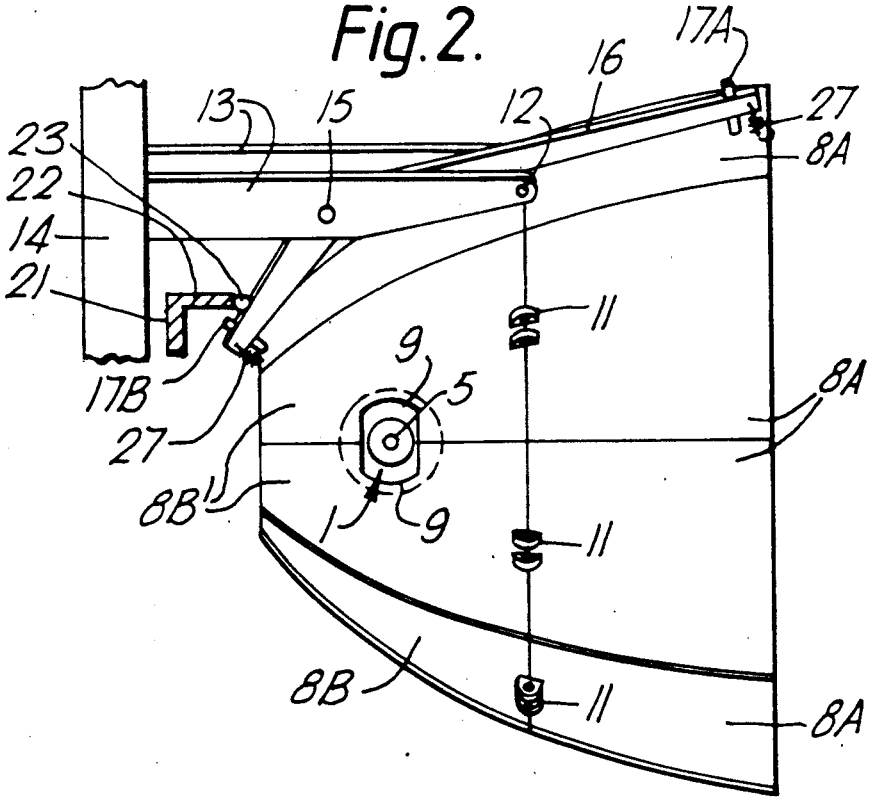
Figure 3:
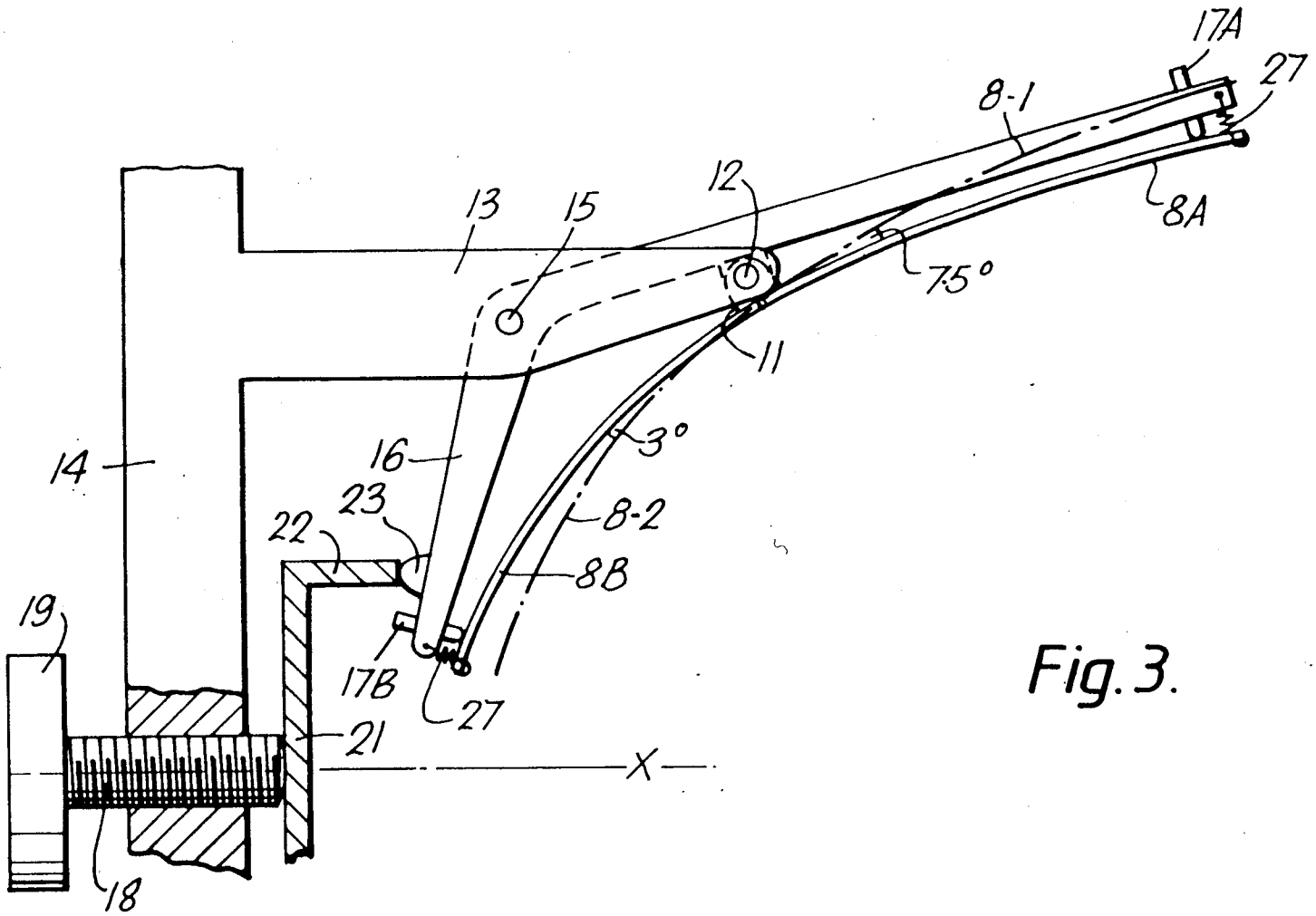
FIG. 3 shows one element of the fitting illustrating the manner in which the fitting operates.

The fitting is designed to accommodate a high intensity high power electric discharge lamp 1 of the kind comprising a tubular quartz discharge envelope 2 having a bulbous central portion 3 containing the lamp electrodes 4, and a terminal 5 at each end connected to a respective electrode by a so-called molybdenum ribbon seal 6.

The lamp is arranged to be supported substantially horizontally and so that it extends transversely within a wrap-around reflector 7 formed in eight individual segments 8 disposed symmetrically around the reflector axis, and each comprising a separate front section 8A and rear section 8B. Each reflector segment 8 is of approximately part-paraboloidal form, so that together they constitute a generally paraboloid reflector. The two sections of each segment are provided on their rear surfaces, at their adjoining ends, with bosses 11 pivotally mounted on a spindle 12 extending between a pair of parallel arms 13 of a support housing, shown in part at 14, so that the two sections can pivot independently of each other. The spindles 12 are tangential to a circle centred on the longitudinal axis X of the reflector. The two rear reflector sections 8B' at each side of the reflector 7 are formed with cut-outs 9 through which the ends of the lamp 1 extend into supports of any convenient kind (not shown) and for the connection of the lamp terminals to respective supply conductors (also not shown).

It will be noted that the reflector segments do not extend completely behind the lamp but the "gap" may be filled with a separate fixed reflector (not shown) to match the reflector segments, but spaced slightly from them to allow for ventilation. The shape of the reflector segments 8A, 8B are such that light from the lamp is directed forwardly in the form of a beam whose angle of divergence can be varied as will now be described.

The arms 13 which support the reflector segments 8A, 8B also carry between them a further spindle 15 on which is pivotally supported an angled actuating arm 16 carrying, at its front and rear ends, studs 17A and 17B which slidingly engage the outer surfaces of the reflector 8A, 8B at their forward and rear ends respectively, springs, as at 27, holding the reflector in contact with the studs.

Thus by pivoting the angled arms 16 the individual sections of the reflector segments are caused to pivot, in turn, about the spindle 12. As the distance between the spindle 15 and the stud 17A at the forward end of the actuating arm 16 is greater than the distance between the spindle 12 and the stud, and the distance between the spindle 15 and the stud 17B at the rear of the actuating arm is less than the distance between the spindle 12 and the stud 17B, the front sections 8A of the segments will pivot through a greater angle than the rear sections 8B. The relative dimensions are selected so that the front sections 8A of the segments turn through approximately 7.5° while the rear sections 8B turn through about 3°. It has been found that by utilising separate reflector sections, which are rotated through different angles through only these few degrees, the angle of divergence of the resultant light beam can be varied considerably, for example from about 10° to 50°, in a substantially gradual manner.

For controlling the positions of the sections 8A, 8B of the reflector segments 8, the rear wall of the housing 14 is pierced by a threaded hole into which is screwed a threaded spindle 18 carrying a control wheel 19 and supporting, within the housing, a circular plate 21 carrying a peripheral, forwardly-extending flange 22 which bears against buffers 23 at the rear of the arms 16. It can therefore be seen that on adjustment of the position of the plate 21, by rotating the control wheel 19, the arms 16, and hence the sections 8A, 8B of the reflector segments 8, are caused to pivot about their respective axes, from the position shown, giving a relatively narrow beam, to the position indicated by the chain lines 8.1, 8.2 giving a wider beam. The arms 16 can be either spring loaded, or appropriately weighted, to cause the reflector segment sections 8A, 8B to return to the narrower beam position when the plate 21 is retracted.

The segments 8 partially overlap at their sides to permit them to move freely between the narrow and wide beam positions.

The reflector may be accommodated in a substantially closed housing provided with opening for permitting a cooling flow of air over the lamp ends, by convection. The front of the housing, in such a case can be closed by a simple glass plate (not shown), as this does not need to be in the form of a lens.

Although the fitting illustrated has eight reflector segments 8, a different number could alternatively be employed. Similarly the configuration of the reflector segments can vary depending upon the particular use to which the fitting is to be put.

It will also be appreciated that a fitting in accordance with the invention is not restricted to use with lamps of the construction illustrated, but may be designed to incorporate other forms of high intensity lamps required to be selectively operated to provide light beams of adjustable angle.

We claim:

1. A lighting fitting for use with an electric lamp having a relatively compact high intensity light source, comprising: a reflector having a longitudinal axis and extending forwardly of the lamp, said reflector including a plurality of separate segments disposed around the lamp and pivotable about respective axes which are tangential to a circle centered on the longitudinal axis of the reflector, each segment having at least two separate sections disposed end to end or partially overlapping in the direction of the longitudinal axis, said at least two separate sections being operatively coupled to means for pivoting said at least two separate sections simultaneously but through different angles.

2. A lighting fitting as claimed in claim 1, wherein each reflector segment is of approximately part-paraboloidal form, said plurality of segments together constituting a generally parabolic reflector.

3. A lighting fitting as claimed in claim 1, wherein adjacent reflector segments partially overlap and slide over one another during operation of the pivoting means.

* * * * *